US009351539B2

(12) United States Patent
Briggs

(10) Patent No.: US 9,351,539 B2
(45) Date of Patent: May 31, 2016

(54) CONTROLLED RELEASE BUCKLE

(71) Applicant: Bell Sports, Inc., Scotts Valley, CA (US)

(72) Inventor: Eamon Briggs, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 501 days.

(21) Appl. No.: 13/711,194

(22) Filed: Dec. 11, 2012

(65) Prior Publication Data

US 2014/0157626 A1 Jun. 12, 2014

(51) Int. Cl.
*A44B 11/06* (2006.01)
*A43C 11/14* (2006.01)

(52) U.S. Cl.
CPC ..... *A43C 11/146* (2013.01); *A43C 11/1473* (2013.01); *A44B 11/065* (2013.01); *Y10T 24/4016* (2015.01); *Y10T 29/49822* (2015.01)

(58) Field of Classification Search
CPC ..... A44B 11/065; Y10T 29/49822; Y10T 24/4016; A43C 11/146; A43C 11/1473
See application file for complete search history.

(56) References Cited

U.S. PATENT DOCUMENTS

| | | | | |
|---|---|---|---|---|
| 5,745,959 | A | 5/1998 | Dodge | |
| 5,745,963 | A | 5/1998 | Graziano | 24/685 |
| 5,887,318 | A | 3/1999 | Nicoletti | 24/71 SK |
| 6,175,994 | B1 | 1/2001 | Nicoletti | 24/68 SK |
| 6,231,066 | B1 | 5/2001 | Okajima | 280/623 |
| 6,325,405 | B2 | 12/2001 | Okajima | 280/623 |
| 6,398,246 | B1 | 6/2002 | Okajima | 280/263 |
| 6,694,644 | B2 | 2/2004 | Haupt | |
| 7,591,050 | B2 | 9/2009 | Hammerslag | 24/68 SK |
| 7,877,845 | B2 | 2/2011 | Signori | 24/68 SK |
| 7,954,204 | B2 | 6/2011 | Hammerslag et al. | 34/68 SK |
| 2002/0189056 | A1 | 12/2002 | Gallina et al. | 24/68 R |
| 2003/0005556 | A1 | 1/2003 | Gallina | 24/68 |
| 2007/0266595 | A1 | 11/2007 | Bird | |
| 2011/0197406 | A1* | 8/2011 | Couzyn | 24/68 E |
| 2011/0266384 | A1 | 11/2011 | Goodman et al. | 242/396.4 |
| 2012/0297591 | A1 | 11/2012 | Bozzetto et al. | |

FOREIGN PATENT DOCUMENTS

| | | |
|---|---|---|
| EP | 2272390 | 1/2011 |
| WO | 2011085485 | 7/2011 |

* cited by examiner

*Primary Examiner* — Robert J Sandy
*Assistant Examiner* — Louis Mercado
(74) *Attorney, Agent, or Firm* — Booth Udall Fuller, PLC

(57) ABSTRACT

In accordance with some embodiments of the present disclosure, a controlled release buckle may comprise a buckle lock configured to engage a strap in a manner preventing the strap from moving in a loosening direction when the buckle lock is in a resting position, and to disengage the strap when the buckle lock is forced into a disengaged position, and a buckle lever configured to move the strap in a tightening direction when the buckle lever is pulled in a first direction, and to engage the strap in a manner preventing the strap from moving in a loosening direction when the buckle lever is pressed in a second direction.

19 Claims, 6 Drawing Sheets

CONTROLLED RELEASE BUCKLE

TECHNICAL FIELD

The present disclosure relates generally to buckles and more particularly to a system and method for a controlled release of a buckle.

BACKGROUND

Athletes in various sports desire footwear that is designed to meet the particular challenges presented by their sport. For example, in many sports, athletes may desire to adjust the tightness of their shoes or other footwear in a relatively fast and easy manner. Such sports may include, but are not limited to, road cycling, mountain biking, skiing, snowboarding, and rollerblading. Cycling shoes, for example, may be constructed of material that loosens as it warms up due to the heat generated by a cyclist during a ride. As such, a cyclist may at times wish to tighten their shoes in the middle of a ride. On the other hand, a cyclist may also experience swelling of their feet during a ride. As such, a cyclist may at times wish to loosen their shoes during a ride. Moreover, whether in a race or out on a friendly group ride, a cyclist may wish to make such adjustments easily without dismounting from the bicycle.

SUMMARY

In accordance with the present disclosure, a controlled release buckle may comprise a buckle lock configured to engage a strap in a manner preventing the strap from moving in a loosening direction when the buckle lock is in a resting position, and to disengage the strap when the buckle lock is forced into a disengaged position, and a buckle lever configured to move the strap in a tightening direction when the buckle lever is pulled in a first direction, and to engage the strap in a manner preventing the strap from moving in a loosening direction when the buckle lever is pressed in a second direction.

The object and advantages of the invention will be realized and attained by means of at least the features, elements, and combinations particularly pointed out in the claims.

It is to be understood that both the foregoing general description and the following detailed description are exemplary and explanatory and are not restrictive of the invention, as claimed.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION

In accordance with the teachings of the present disclosure, a method and system for providing a controlled release of a buckle is provided.

Figure 1:
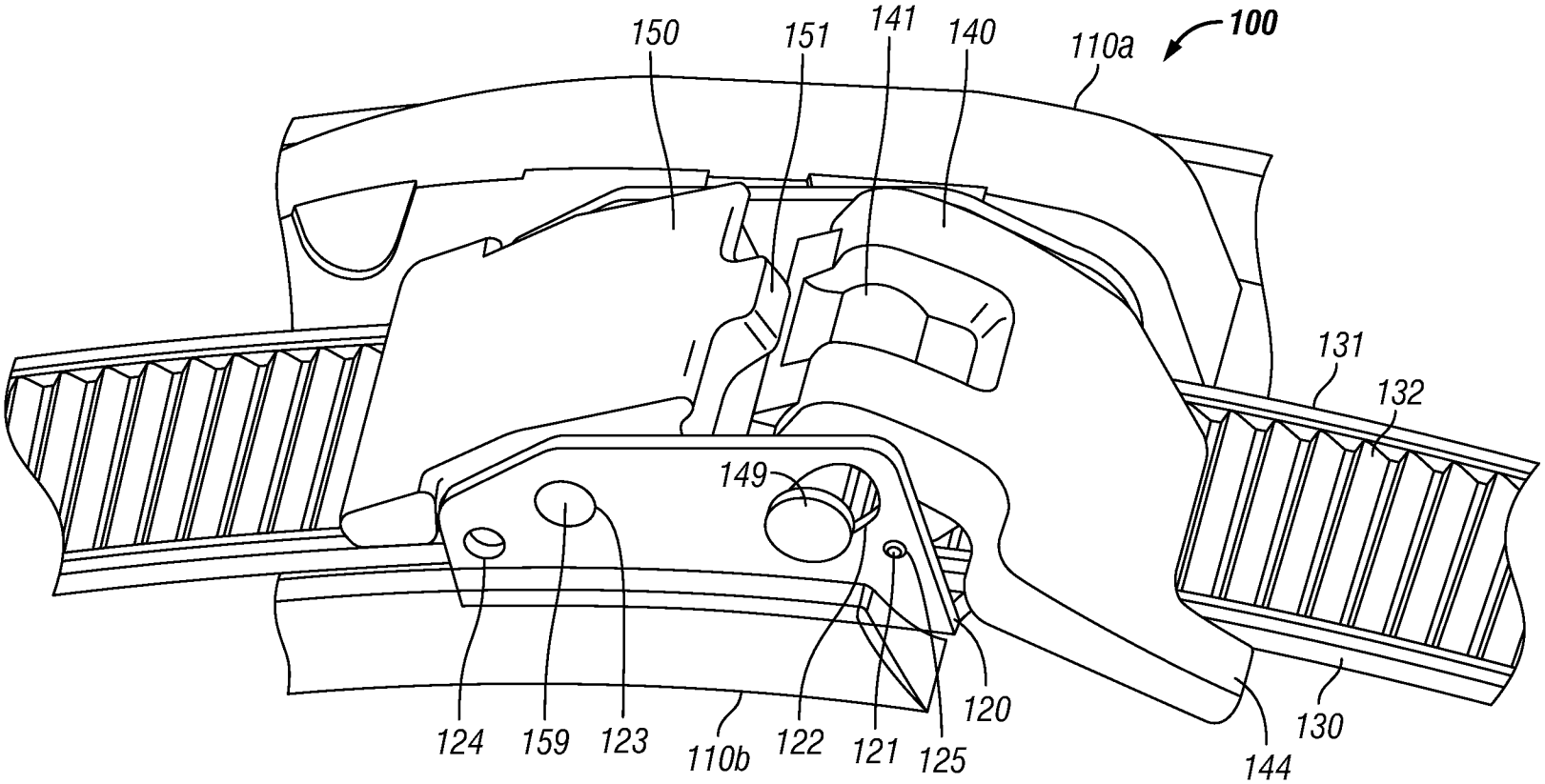
FIG. 1 illustrates a controlled release buckle, in accordance with certain embodiments of the present disclosure.

FIG. 1 illustrates a controlled release buckle 100, in accordance with certain embodiments of the present disclosure. Controlled release buckle 100 may include a shoe base 110, a buckle base 120, a strap 130, a buckle lever 140, a lever bar 149, a lever pin 125, a buckle lock 150, and a lock bar 159. Shoe base 110 may include multiple portions. As shown in FIG. 1, shoe base 110 may include a first portion 110*a* disposed on one side of buckle base 120, and a second portion 110*b* disposed on another side of buckle base 120. In some embodiments, shoe base 110 may be coupled to the upper portion of a shoe (not illustrated) such as a cycling shoe. Shoe base 110 may also be coupled to buckle base 120.

Although the disclosure describes various embodiments of controlled release buckle 100 as it may be used on a cycling shoe, the various embodiments may be utilized on any type of shoe requiring tightening and loosening, including, but not limited to, road cycling shoes, mountain biking shoes, snow board boots, ski boots, and rollerblades. As such, the term "shoe" may be used to describe any type of footwear, including, but not limited to, various types of athletic shoes, boots, and rollerblades. Moreover, various embodiments of controlled release buckle 100 may be used in applications beyond footwear. Controlled release buckle 100 may be used in any application in which controlled loosening and/or tightening may be desired, for example, a belt buckle or a tie-down strap.

Strap 130 may include one or more rails 131 and multiple strap teeth 132. In some embodiments, strap 130 may be connected, at one end, to a flap (not illustrated) of a shoe. Accordingly, the shoe may be tightened or loosened as the position of strap 130 is adjusted by buckle lever 140 and buckle lock 150. Strap teeth 132 on strap 130 may be configured to allow buckle lever 140 and buckle lock 150 to engage strap 130 while tightening and/or loosening the shoe. For the purposes of the present disclosure, the surface of strap tooth 132 facing the tightening direction may be referred to as the "leading surface," and the surface facing the loosening direction may be referred to as the "following surface." In some embodiments, strap teeth 132 may have a sawtooth shape with the leading surface sloping at an angle and the following surface extending at an angle roughly perpendicular to the strap. In some embodiments, however, the leading surface and the trailing surface of strap tooth 132 may extend from the base of strap 130 at a sloping angle.

In some embodiments, a user may pull up on buckle lever 140 and/or lever extension 144 to ratchet the strap and the shoe tighter. In some embodiments, a user may also press down on buckle lever 140 and/or lever extension 144 to controllably release strap 130 and thus controllably loosen the shoe. Moreover, a user may press down on buckle lock 150 to fully release strap 130 and thus fully loosen the shoe. The interaction between buckle lever 140, buckle lock 150, and strap 130 is described in further detail below with reference to FIG. 3 through FIG. 6.

Rails 131 may be configured on one or both sides of strap 130. Rails 131 may provide a consistent thickness to at least the outside portions of strap 130. Accordingly, rails 131 may improve strap 130's resistance to wear, fatigue, and potentially harsh weather conditions.

Buckle base 120 may include various openings that may be utilized by various components of controlled release buckle 100 to hold those components in place. For example, buckle base 120 may include a pin hole 121, a slotted lever hole 122, a lock hole 123, and a lock spring hole 124.

Lever pin 125 may extend from pin hole 121 on one side of buckle base 120 to an opposing pin hole 121 on an opposing side of buckle base 120. When buckle lever 140 and/or lever extension 144 is pushed downward, buckle lever 140 may rotate about lever pin 125. Similarly, lever bar 149 may extend from slotted lever hole 122 on one side of buckle base 120 to an opposing slotted lever hole 122 on an opposing side of buckle base 120. Lever bar 149 may be rotatably coupled to buckle lever 140. Moreover, lever bar 149 and buckle lever 140 may be spring-loaded such that lever bar 149 may be disposed in the lower portion of slotted lever hole 122 when buckle lever 140 is in a resting position, but may move within slotted lever hole 122 depending on the forces that may be applied to buckle lever 140. For example, when a downward force is applied to buckle lever 140 and/or lever extension 144, buckle lever 140 may rotate about lever pin 125 as described above, and lever bar 149 may move to a higher position within slotted lever hole 122. On the other hand, if an upward force is applied to buckle lever 140 and/or lever extension 144, buckle lever 140 may rotate about lever bar 149.

Lock bar 159 may extend from lock hole 123 on one side of buckle base 120 to an opposing lock hole 123 on an opposing side of buckle base 120. When buckle lock 150 is pushed downward, buckle lock 150 may rotate about lock bar 159.

As shown in FIG. 1, buckle lever 140 may include a lever extension 144 and a lever indent 141. Lever extension 144 may be configured such that when buckle lever 140 is pressed substantially downward, lever extension 144 may extend past strap 130 without making contact with strap 130. Accordingly, lever extension 144 may have a relatively flat and aerodynamic profile when in a resting position (as described in greater detail below with reference to FIG. 3), and may also have an extended range of downward motion that may be easy for a user to manipulate. As discussed in greater detail below with reference to FIG. 5, the extended range of downward motion may allow buckle lever 140 to engage strap 130 during a controlled release action. Likewise, lever indent 141 may be configured to extend buckle lever 140's range of motion when buckle lever 140 and/or lever extension 144 is being pulled upward. In some embodiments, lever indent 141 may be configured to align with a lock extension 151 on buckle lock 150. Accordingly, when lever extension 144 is pulled upward and buckle lever 140 rotates about lever bar 149, lever indent 141 may allow buckle lever 140 to have an extended range of motion toward buckle lock 150 without the top of buckle lever 140 coming into contact with lever extension 151. This extended range of motion may extend the distance that buckle lever 140 may rotate, and thus may extend the amount of tightening that may be performed during a tightening action.

Buckle lock 150 may include lock extension 151. As described above, lock extension 151 may align with lever indent 141 such that lock extension 151 does not limit buckle lever 140's range of motion when buckle lever 140 and/or lever extension 144 is pulled upward and rotates about lever bar 149. However, in some embodiments, lock extension 151 may be configured such that it does make contact with underlying portions of buckle lever 140 when buckle lever 140 and/or lever extension 144 is pushed downward and the underlying portions of buckle lever 140 rotate about lever pin 125 toward buckle lock 150. The interaction between buckle lock 150 and buckle lever 140 when buckle lever 140 and/or lever extension 144 are pushed downward are discussed below in further detail with reference to FIG. 5.

Figure 2:
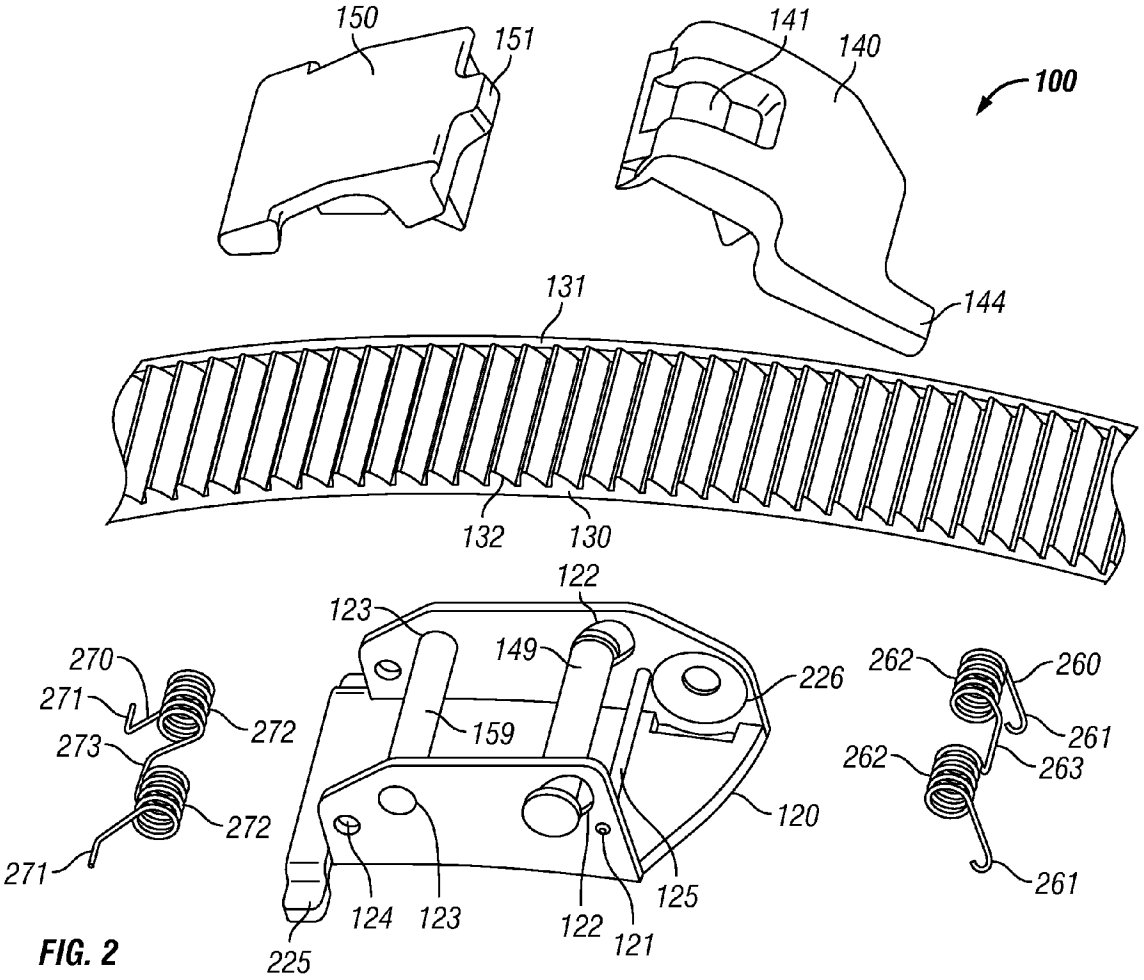
FIG. 2 illustrates an exploded view of certain components of a controlled release buckle, in accordance with certain embodiments of the present disclosure.

FIG. 2 illustrates an exploded view of certain components of controlled release buckle 100, in accordance with certain embodiments of the present disclosure. As shown in FIG. 2, controlled release buckle 100 may include various components that are hidden in other views. For example, controlled release buckle 100 may include a lever spring 260 and a lock spring 270. In some embodiments, lever spring 260 may include two attachment ends 261, two coiled portions 262, and a middle portion 263. Lever spring 260 may be coupled to lever pin 125 at its attachment ends 261. The coiled portions 262 may be disposed around lever bar 149, and the middle portion 263 may come in contact with and provide biasing forces to buckle lever 140. For example, lever spring 260 may provide a rotational bias for buckle lever 140 when buckle lever 140 is pulled upward and rotates about lever bar 149, and may provide a directional bias for buckle lever 140 when buckle lever 140 is pushed downward and rotates about lever pin 125.

Similar to lever spring 260, some embodiments of lock spring 270 may include two attachment ends 271, two coiled portions 272, and a middle portion 273. Lock spring 270 may be configured such that its attachment ends 271 are disposed within lock spring holes 124 of buckle base 120. The coiled portions 272 may be disposed around lock bar 159, and the middle portion 273 may come in contact and provide bias forces to buckle lock 150. For example, lock spring 270 may provide a rotational bias for buckle lock 150 when buckle lock 150 is pushed downward and rotates about lever bar 159. As described in greater detail below with reference to FIG. 5, when buckle lever 140 is pushed downward, buckle lever 140 may rotate about lever bar 149 and a portion of buckle lever 140 may come in contact with a portion of buckle lock 150 (e.g., lock extension 151), apply an upward force on an underneath surface of buckle lock 150, and cause buckle lock 150 to rotate about lever bar 159. Accordingly, the rotational bias applied to buckle lock 150 by lock spring 270 may, in some embodiments, also provide a bias for buckle lever 140 when buckle lever 140 is pushed downward.

As shown in FIG. 2, buckle base 120 may include a base hole 226 and a lip 225. In some embodiments, base hole 226 may be disposed on one side of buckle base 120 and may be configured to allow buckle base 120 to be coupled to shoe base 110*a*. For example, base hole 226 may be configured to allow a fastening device such a screw (not expressly shown) to fasten buckle base 120 to shoe base 110. Though base hole 226 may be illustrated in FIG. 2 on a vertical wall of buckle base 120, base hole 226 may be located in any suitable location on buckle base 120. For example, in some embodiments, base hole 226 may be located on the bottom wall of buckle base 120 and may allow a fastening device to attach buckle base 120 to a portion of shoe base 110 located underneath buckle base 120. In some embodiments, lip 225 may be disposed on one end of buckle base 120 and may be configured to fit underneath certain features of shoe base 110*b*, and thus may secure buckle base 120 to shoe base 110*b*. In some embodiments, a lip 225 may also be disposed on the opposing side of buckle base 120, and provide additional securing of buckle base 120 to shoe base 110*a*. In some embodiments, buckle base 120 may be fastened to shoe base 110 by any other suitable techniques. For example, in some embodiments, buckle base 220 may be fastened to shoe base 110 with glue.

Figure 3:
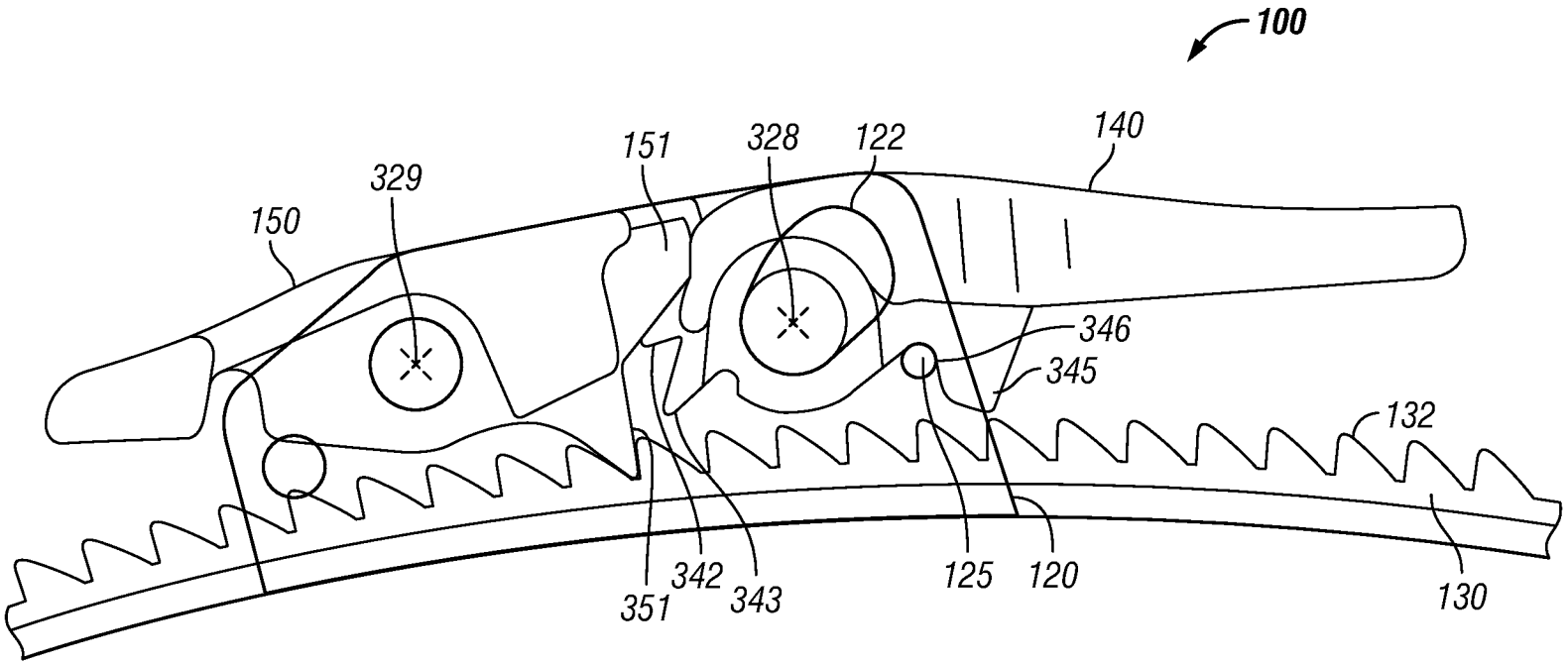
FIG. 3 illustrates a side view of a controlled release buckle in a resting position, in accordance with certain embodiments of the present disclosure.
Figure 4:
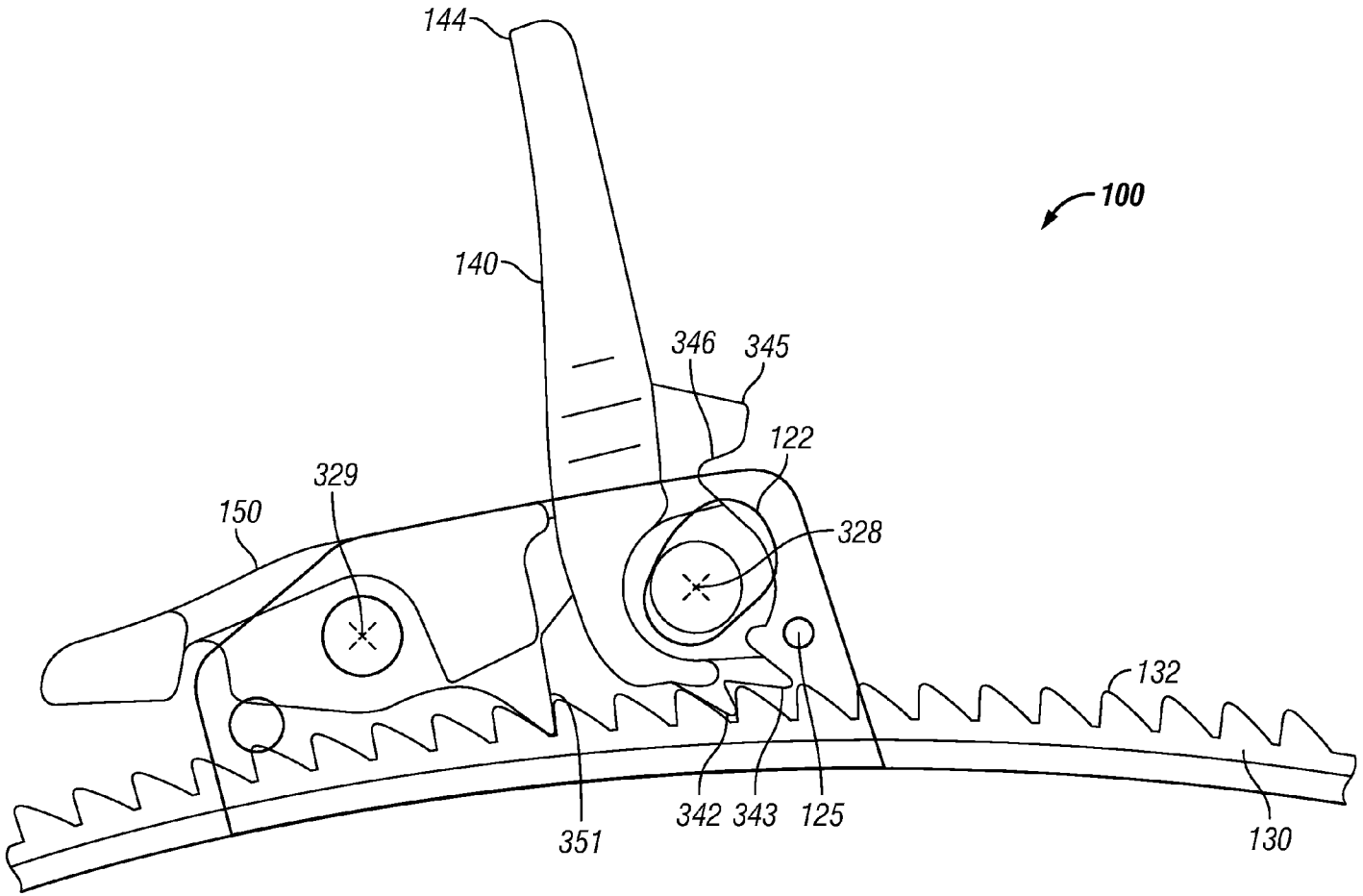
FIG. 4 illustrates a side view of a controlled release buckle during a tightening action, in accordance with certain embodiments of the present disclosure.
Figure 5:
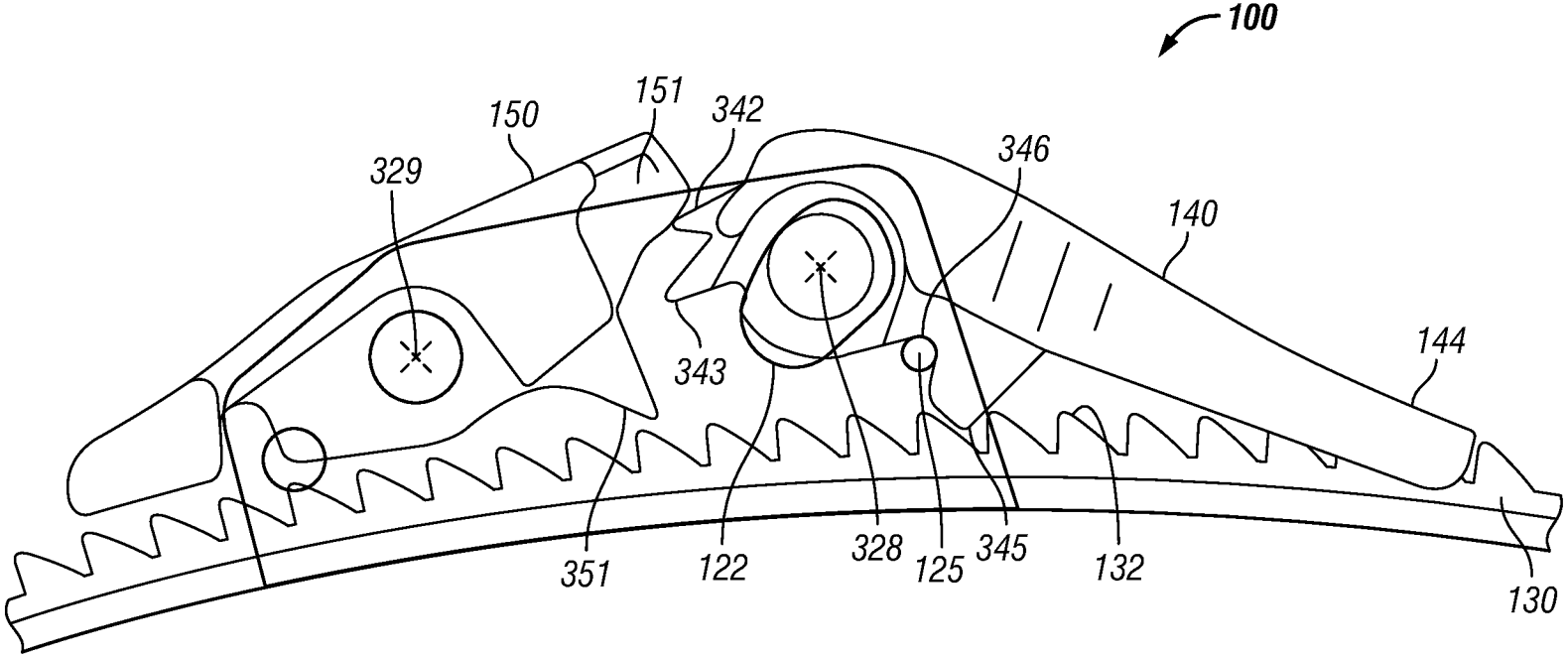
FIG. 5 illustrates a side view of a controlled release buckle during a controlled release action, in accordance with certain embodiments of the present disclosure.

FIG. 3 through FIG. 5 illustrate various side views of controlled release buckle 100, in accordance with certain embodiments of the present disclosure. For simplicity, some components of controlled release buckle 100 may be omitted from FIG. 3 through FIG. 5. For example, the lever bar 149 is not shown in FIG. 3 through FIG. 5, but the axis formed by lever bar 149 may be represented by lever axis 328. Similarly, the lock bar 159 is not shown in FIG. 3 through FIG. 5, but the axis formed by lock bar 159 may be represented by lock axis 329. Moreover, buckle base 120 may be illustrated as a transparent component in order to show a side view of buckle lever 140 and buckle lock 150. Likewise, the rails 131 of strap 130 may be omitted in order to more clearly illustrate the strap teeth 132 of strap 130.

FIG. 3 illustrates a side view of controlled release buckle 100 in a resting position, in accordance with certain embodiments of the present disclosure. In some embodiments, buckle lever 140 may include a first lever tooth 343, a second lever tooth 342, a lever stopper 345, and a pin indent 346. As shown in FIG. 3, when buckle lever 140 is in a resting position, pin indent 346 may rest on lever pin 125. Moreover, first lever tooth 343, second lever tooth 342, as well as lever stopper 345 may be disengaged from strap teeth 132 on strap 130, when buckle lever 140 is in a resting position.

In some embodiments, buckle lock 150 may include a lock tooth 351. As shown in FIG. 3, when controlled release buckle 100 is in a resting position (i.e., when the user is not applying force to either buckle lever 140 or buckle lock 150), lock tooth 351 may engage strap tooth 132 and prevent strap 130 from loosening in a counterclockwise direction.

FIG. 4 illustrates a side view of controlled release buckle 100 during a tightening action, in accordance with certain embodiments of the present disclosure. In some embodiments, strap 130 may be tightened in a clockwise direction when the user lifts up on buckle lever 140 and/or lever extension 144. For example, when buckle lever 140 and/or lever extension 144 is pulled in an upward direction, buckle lever 140 may rotate about lever axis 328. Accordingly, first lever tooth 343 and second lever tooth 342 may engage strap teeth 132 and tighten strap in a clockwise direction. In some embodiments, a tightening action may provide between one and three strap teeth 132 worth of tightening, depending on how far the user lifts the buckle lever 140 and/or lever extension 144. However, in some embodiments, buckle lever 140 and surrounding components may be configured to provide any suitable amount of tightening depending in part on the range of rotational motion allowed for buckle lever 140. As strap 130 tightens in a clockwise direction, lock tooth 351 may glide over the sawtooth leading surfaces of strap teeth 132 and then, when the tightening action is complete, engage with the trailing surface of strap tooth 132 to maintain strap 130's position relative to the buckle base 120. As described above with reference to FIG. 1, the slotted shape of slotted lever hole 122 may allow the lever axis 328 to move. Accordingly, the spring loaded position of buckle lever 140 and lever axis 328 may adjust as needed to provide the vertical clearance that may be necessary when first lever tooth 343 and second lever tooth 342 engage strap teeth 132 during a tightening action, and also when buckle lever 140 recoils back to a resting position after a tightening action.

FIG. 5 illustrates a side view of controlled release buckle 100 during a controlled release action, in accordance with certain embodiments of the present disclosure. In some embodiments, strap 130 may be loosened in a controlled manner when buckle lever 140 and/or lever extension 144 is pressed downward.

As shown in FIG. 5, when buckle lever 140 and/or lever extension 144 are pressed downward, buckle lever 140 may rotate about lever pin 125. As buckle lever 140 rotates about lever pin 125, buckle lever 140 may apply an upward force on lever bar 149, which may be spring-loaded. As described above with reference to FIG. 1, the slotted shape of slotted lever hole 122 may allow the spring-loaded lever bar 149 (represented by axis 328 in FIG. 5) to move upward in the direction of the slot. Moreover, when a disengaging force is applied to buckle lock 150, lock tooth 351 may disengage from strap teeth 132. In some embodiments, such a disengaging force may be applied to buckle lock 150 by a user. In such embodiments, a controlled release of strap 130 may be activated by two separate forces from the user, one on buckle lever 140 and one on buckle lock 150. However, in some embodiments, a disengaging force may be applied to buckle lock 150 by buckle lever 140. In such embodiments, a controlled release of strap 130 may be activated by a single force from the user on buckle lever 140. For example, in some embodiments, second lever tooth 342 may contact buckle lock 150 and/or lock extension 151 when buckle lever 140 is pressed and rotated about lever pin 125. In some embodiments, buckle lever 140 and/or buckle lock 150 may be configured such that another portion of buckle lever 140 may contact buckle lock 150 when buckle lever 140 is pressed downward. For example, in some embodiments, buckle lever 140 may include a wedge (not expressly shown) that may extend from buckle lever 140 at a location outside of buckle base 120 and that may be configured to contact an embodiment of buckle extension 151 that may extend from buckle lock 150 at a location outside of buckle base 120. An upward force from a portion of buckle lever 140 applied to a portion of buckle lock 150 may cause buckle lock 150 to rotate about lock axis 329 and thus may cause lock tooth 351 to disengage from strap teeth 132. Accordingly, strap 130 may be allowed to begin loosening in a counterclockwise direction. However, with buckle lever 140 in a downwardly pressed position, a strap tooth 132 may come into contact with lever stopper 345 as strap 130 moves slightly in a loosening direction. Accordingly lever stopper 345 may engage strap 130 by catching the next strap tooth 132, and may stop strap 130 from moving any further in a loosening direction.

When buckle lever 140 is subsequently released, the spring bias applied to buckle lever 140 and buckle lock 150 may force buckle lever 140 and buckle lock 150 to move back to their respective resting positions. As lever stopper 345 disengages from strap 130, strap 130 may be allowed to begin moving in a loosening direction. However, with buckle lock 150 back in a resting position, lock tooth 351 may re-engage strap 130 by catching the next strap tooth 132, and may prevent strap 130 from moving any further in a loosening direction. Accordingly, the loosening of strap 130 may occur in a controlled manner. In some embodiments, buckle lever 140 and buckle lock 150 may be configured such that the total distance that strap 130 moves during a single controlled loosening action (i.e., the pressing of buckle lever 140 and a subsequent release of buckle lever 140) may be the distance between a first strap tooth 132 and a second strap tooth 132. Moreover, in some embodiments, the second strap tooth may be adjacent to the first strap tooth. Thus, in such embodiments, a single pressing of buckle lever 140 and/or lever extension 144 may provide a predetermined amount of loosening that is equal the distance between adjacent strap teeth 132. Such controlled loosening may allow a cyclist, for example, to simply to reach down and controllably loosen their shoe by simply pushing and releasing buckle lever 140 with one finger. Moreover, a cyclist could repeat this simple action one or more times until the shoe is loosened to an ideal setting. Such an ergonomic and simple method for controllably loosening a shoe may allow a cyclist to perform a controlled loosening of their shoe without dismounting from their bicycle.

In some embodiments, a frictional force may be applied to strap 130. Such a frictional force may improve the consistency with which the controlled release buckle 100 operates, including when strap 130 is in a state of high tension and the shoe is very tight. For example, in some embodiments, a lock pin (not expressly shown) may extend from one lock spring hole 124 on one side of buckle base 120 to an opposing lock spring hole 124 on the opposing side of buckle base 120. In such embodiments, lock spring 270 may include connecting ends that may be connected to the lock pin. Moreover, lock spring hole 124 and the lock pin may be located at a height on buckle base 120 such that the lock pin comes into contact with strap 130 and causes a frictional resistance to strap 130 moving in the tightening or the loosening direction. Such a frictional resistance may oppose a strong loosening force that may cause skipping of strap teeth 132 when the shoe is in a very tight setting.

In some embodiments, buckle lock 150 and buckle lever 140 may be configured such that lock tooth 351 may disengage strap teeth 132 at a sufficient distance before lever stopper 345 engages strap teeth 132 for the user to manually control the loosening of strap 130 by manually adjusting the downward pressure applied to buckle lever 140. For example, in some embodiments, the user may manually adjust the pressure applied to buckle lever 140 as lever stopper 345 comes into contact with consecutive strap teeth 132 in order to let a desired number of strap teeth 132 pass. In such embodiments, a single pressing of buckle lever 140 and/or lever extension 144 with a manually adjusted pressure may provide any manually controlled amount of loosening desired by the user.

The mechanism for providing a controlled release of strap 130 illustrated in FIG. 5 may be combined with a mechanism to fully loosen strap 130. In some embodiments, buckle lever 140 may rest in a position as shown in FIG. 3 when no force is being applied to buckle lever 140 and/or lever extension 144. In such a resting position, first lever tooth 343, second lever tooth 342, and lever stopper 345 may all be disengaged from strap teeth 132. A downward force may be applied to buckle lock 150, which may cause lock 151 to rotate about lock axis 329. Accordingly, lock tooth 351 may disengage from strap teeth 132, and strap 130 may be unimpeded from fully loosening in a counterclockwise direction.

Figure 6:
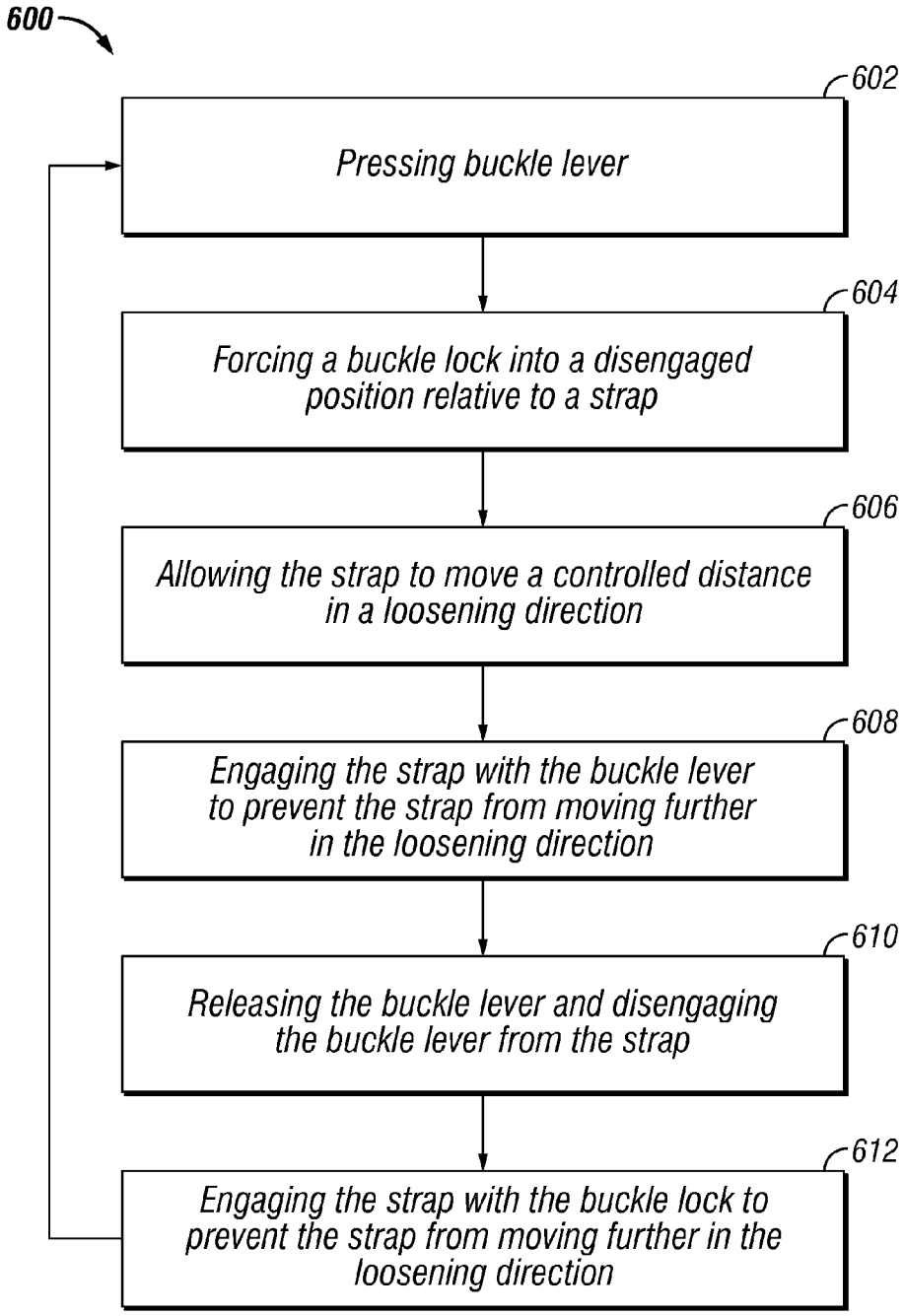
FIG. 6 illustrates a method for controllably releasing a buckle, in accordance with certain embodiments of the present disclosure.

FIG. 6 illustrates a method 600 for controllably releasing a buckle, in accordance with certain embodiments of the present disclosure.

At step 602, method 600 may require pressing buckle lever 140. Buckle lever 140 may be pressed, for example, by a user of the shoe on which controlled release buckle 100 may be placed.

At step 604, method 600 may require forcing a buckle lock 150 into a disengaged position relative to strap 130. In some embodiments, when buckle lever 140 is pressed, buckle lever 140 may come into contact with buckle lock 150 and in turn force buckle lock 150, and in particular lock tooth 351, into a disengaged position. In some embodiments, however, buckle lock 150 may also be forced into a disengaged position relative to strap 130 by a user pressing on buckle lock 150 in a manner that may cause buckle lock 150 to rotate about buckle axis 329, and thus may cause lock tooth 351 to disengage from strap 130.

At step 606, method 600 may require allowing strap 130 to move a controlled distance in a loosening direction. As buckle lock 150 disengages from strap 130, the strap may be allowed to move slightly in a loosening direction until a strap tooth 132 of strap 130 comes into contact with buckle stopper 345 as described in further detail below with reference to step 608.

At step 608, method 600 may require engaging strap 130 with buckle lever 140 to prevent strap 130 from moving further in the loosening direction. During step 608, buckle lever 140, and in particular buckle stopper 345, may come into contact with strap tooth 132 as strap 130 moves in the loosening direction, and thus may prevent strap 130 from moving any further in the loosening direction.

At step 610, method 600 may require releasing buckle lever 140 and disengaging buckle lever 140 from strap 130. For example, after pressing buckle lever 140, a user may release buckle lever 140. At that time, the spring bias applied to buckle lever 140 may return buckle lever 140 to a resting position in which buckle lever 140, and in particular lever stopper 345, may be disengaged from strap 130.

At step 612, method 600 may require engaging the buckle lock to prevent the strap from moving further in the loosening direction. In some embodiments, strap 130 may be allowed to move slightly in a loosening direction as lever stopper 345 disengages from strap 130 in step 610. However, as buckle lever 140 returns to a resting position, the force on buckle lock 150, whether directly from a user or indirectly through contact with buckle lever 140, may be released. Accordingly, the spring bias on buckle lock 150 may return buckle lock 150 to its resting position, in which buckle lock 150 may re-engage strap 130. At this time, buckle lock 150, and in particular lock tooth 351, may catch strap tooth 132 as it moves in a loosening direction, and prevent strap 130 from moving any further in the loosening direction.

During the steps provided by method 600, strap 130 may, in some embodiments, move in the loosening direction a total distance defined by the distance between adjacent strap teeth. In such embodiments, if a user desires to loosen the strap further, the steps of method 600 may be repeated.

Although FIG. 6 discloses a particular number of steps to be taken with respect to method 600, method 600 may be executed with greater or lesser steps than those depicted in FIG. 6. In addition, although FIG. 6 discloses a certain order of steps to be taken with respect to method 600, the steps comprising method 600 may be completed in any suitable order. For example, in some embodiments, step 606 may occur between steps 604 and 608, and then be repeated between steps 610 and 612.

Although the above disclosure may refer to strap 130 tightening in the "clockwise" direction and loosening in the "counterclockwise" direction, those directions are merely exemplary for purposes of referring to the specific embodiments depicted in FIGS. 1-5. Various embodiments of controlled release buckle 100 may be configured to tighten in any given direction and loosen in any given opposing direction. For example, an embodiment of controlled release buckle 100 configured on a left shoe may have a tightening direction that may be opposite from a tightening direction for another embodiment of controlled release buckle 100 configured on a right shoe. Likewise, the respective loosening directions may be opposite for embodiments of controlled release buckle 100 configured on different sided shoes.

What is claimed is:

1. A controlled release buckle, comprising:

a buckle lock configured to engage a strap in a manner preventing the strap from moving in a loosening direction when the buckle lock is in a resting position, and to disengage the strap when the buckle lock is forced into a disengaged position; and a buckle lever configured to move the strap in a tightening direction when the buckle lever is pulled in a first direction, and to engage the strap in a manner preventing the strap from moving in a loosening direction when the buckle lever is pressed in a second direction;

wherein the buckle lever is configured to contact the buckle lock and force the buckle lock into the disengaged position when the buckle lever is pressed in the second direction.

2. The controlled release buckle of claim 1, wherein the buckle lever and the buckle lock are configured to allow the strap to move a predetermined distance in the loosening direction when the buckle lever is pressed in the second direction and subsequently released.

3. The controlled release buckle of claim 2, wherein:

the strap comprises teeth each having a trailing surface facing the loosening direction and a leading surface facing the tightening direction; and the predetermined distance is defined by a length from a first tooth on the strap to a second tooth on the strap.

4. The controlled release buckle of claim 1, wherein:

the strap comprises teeth each having a trailing surface facing the loosening direction and a leading surface facing the tightening direction; and the buckle lock comprises a lock tooth extending from a bottom portion of the buckle lock and shaped to catch the trailing surface of a strap tooth when the buckle lock is in the resting position.

5. The controlled release buckle of claim 1, wherein:

the strap comprises teeth each having a trailing surface facing the loosening direction and a leading surface facing the tightening direction; and the buckle lever comprises:

a first lever tooth configured to push the trailing surface of a first strap tooth in the tightening direction when the buckle lever is pulled in the first direction;

a second lever tooth configured to push the trailing surface of a second strap tooth in the tightening direction when the buckle lever is pulled in the first direction; and a lever stopper configured to catch the trailing surface of a third strap tooth and prevent the third strap tooth from moving in the loosening direction when the buckle lever is pressed in the second direction.

6. The controlled release buckle of claim 1, wherein:

the buckle lever is configured to rotate about a lever bar when the buckle lever is pulled in the first direction; and the buckle lever is configured to rotate about a lever pin when the buckle lever is pressed in the second direction.

7. The controlled release buckle of claim 1, wherein:

the buckle lock comprises a lock extension that extends from a main body of the buckle lock;

the buckle lever comprises a lever indent configured to align with the lock extension when the buckle lever is pulled in the first direction; and the buckle lever is configured to contact the buckle lock at a bottom portion of the lock extension when the buckle lever is pressed in the second direction.

8. A shoe, comprising:

a strap configured such that the shoe tightens when the strap is adjusted in a tightening direction, and the shoe loosens when the strap is adjusted in a loosening direction; and a controlled release buckle comprising:

a buckle lock configured to engage the strap in a manner preventing the strap from moving in the loosening direction when the buckle lock is in a resting position, and to disengage the strap when the buckle lock is pressed into a disengaged position; and a buckle lever configured to move the strap in the tightening direction when the buckle lever is pulled in a first direction, and to engage the strap in a manner preventing the strap from moving in the loosening direction when the buckle lever is pressed in a second direction, wherein:

the buckle lever is configured to rotate about a lever bar when the buckle lever is pulled in the first direction, and the buckle lever is configured to rotate about a lever pin when the buckle lever is pressed in the second direction.

9. The shoe of claim 8, wherein the buckle lever is configured to contact the buckle lock and force the buckle lock into the disengaged position when the buckle lever is pressed in the second direction.

10. The shoe of claim 9, wherein the buckle lever and the buckle lock are configured to allow the strap to move a predetermined distance in the loosening direction when the buckle lever is pressed in the second direction and subsequently released.

11. The shoe of claim 10, wherein:

the strap comprises teeth each having a trailing surface facing the loosening direction and a leading surface facing the tightening direction; and the predetermined distance is defined by a length from a first tooth on the strap to a second tooth on the strap.

12. The shoe of claim 9, wherein:

the buckle lock comprises a lock extension that extends from a main body of the buckle lock;

the buckle lever comprises a lever indent configured to align with the lock extension when the buckle lever is pulled in the first direction; and the buckle lever is configured to contact the buckle lock at the lock extension when the buckle lever is pressed in the second direction.

13. The shoe of claim 8, wherein:

the strap comprises teeth each having a trailing surface facing the loosening direction and a leading surface facing the tightening direction; and the buckle lock comprises a lock tooth extending from a bottom portion of the buckle lock and shaped to catch the trailing surface of a strap tooth when the buckle lock is in the resting position.

14. The shoe of claim 8, wherein:

the strap comprises teeth each having a trailing surface facing the loosening direction and a leading surface facing the tightening direction; and the buckle lever comprises:

a first lever tooth configured to push the trailing surface of a first strap tooth in the tightening direction when the buckle lever is pulled in the first direction;

a second lever tooth configured to push the trailing surface of a second strap tooth in the tightening direction when the buckle lever is pulled in the first direction; and a lever stopper configured to catch the trailing surface of a third strap tooth and prevent the third strap tooth from moving in the loosening direction when the buckle lever is pressed in the second direction.

15. A controlled release buckle, comprising:

a strap comprising teeth each having a trailing surface facing a loosening direction and a leading surface facing a tightening direction;

a buckle lock configured to engage the strap in a manner preventing the strap from moving in the loosening direction when the buckle lock is in a resting position, and to disengage the strap when the buckle lock is forced into a disengaged position; and a buckle lever configured to move the strap in the tightening direction when the buckle lever is pulled in a first direction, and to engage the strap in a manner preventing the strap from moving in the loosening direction when the buckle lever is pressed in a second direction, wherein the buckle lever further comprises:

a first lever tooth configured to push the trailing surface of a first strap tooth in the tightening direction when the buckle lever is pulled in the first direction, a second lever tooth configured to push the trailing surface of a second strap tooth in the tightening direction when the buckle lever is pulled in the first direction, and a lever stopper configured to catch the trailing surface of a third strap tooth and prevent the third strap tooth from moving in the loosening direction when the buckle lever is pressed in the second direction.

16. The controlled release buckle of claim 15, wherein the buckle lever is configured to contact the buckle lock and force the buckle lock into the disengaged position when the buckle lever is pressed in the second direction.

17. The controlled release buckle of claim 15, wherein the buckle lever and the buckle lock are configured to allow the strap to move a predetermined distance in the loosening direction when the buckle lever is pressed in the second direction and subsequently released.

18. The controlled release buckle of claim 15, wherein:

the buckle lock comprises a lock extension that extends from a main body of the buckle lock;

the buckle lever comprises a lever indent configured to align with the lock extension when the buckle lever is pulled in the first direction; and the buckle lever is configured to contact the buckle lock at a bottom portion of the lock extension when the buckle lever is pressed in the second direction.

19. The controlled release buckle of claim 15, wherein:

the buckle lever is configured to rotate about a lever bar when the buckle lever is pulled in the first direction; and the buckle lever is configured to rotate about a lever pin when the buckle lever is pressed in the second direction.

* * * * *